US006601493B1

(12) United States Patent
Crofutt

(10) Patent No.: US 6,601,493 B1
(45) Date of Patent: Aug. 5, 2003

(54) BAND SAW FENCE SYSTEMS AND METHODS

(75) Inventor: William E. Crofutt, Sedro Woolley, WA (US)

(73) Assignee: Grizzly Industrial, Inc., Bellingham, WA (US)

( * ) Notice: Subject to any disclaimer, the term of this patent is extended or adjusted under 35 U.S.C. 154(b) by 84 days.

(21) Appl. No.: 09/692,891

(22) Filed: Oct. 19, 2000

(51) Int. Cl.[7] ..... B27B 27/08

(52) U.S. Cl. ..... 83/438; 83/468.2; 83/810; 269/303; 144/253.1

(58) Field of Search ..... 83/438, 788, 809, 83/810, 813, 477.2, 418, 419, 421, 425, 443, 445, 467.1, 468.2, 468.3, 468.7; 269/303; 144/253.1, 253.6, 253.7, 253.8, 253.9

(56) References Cited

U.S. PATENT DOCUMENTS

| | | | | | |
|---|---|---|---|---|---|
| 13,670 | A | | 10/1855 | Worden | |
| 30,998 | A | * | 12/1860 | Wright | 269/203 |
| 97,950 | A | * | 12/1869 | Meriam | 83/438 |
| 133,577 | A | * | 12/1872 | Finn | 83/438 |
| 172,279 | A | * | 1/1876 | Sawyer | 83/438 |
| 381,752 | A | | 4/1888 | Beach | |
| 425,297 | A | * | 4/1890 | Capron | 83/438 |
| 575,709 | A | | 1/1897 | Drew | |
| 1,789,125 | A | | 1/1931 | Wilderson | |
| 2,064,607 | A | | 12/1936 | Hirtz, Sr. | |
| 2,754,859 | A | * | 7/1956 | Ocenasek | 144/253.1 |
| 3,508,590 | A | | 4/1970 | Sprague, Sr. | |
| 4,002,329 | A | * | 1/1977 | Petrowski | 269/318 |
| 4,432,263 | A | * | 2/1984 | Kowalchuk | 83/438 |
| 4,481,846 | A | * | 11/1984 | Goodell | 144/253.1 |
| 4,600,184 | A | * | 7/1986 | Ashworth | 269/303 |
| 4,911,048 | A | | 3/1990 | Osborne | |
| 5,447,085 | A | * | 9/1995 | Gochnauer | 144/253.5 |

* cited by examiner

*Primary Examiner*—Allan N. Shoap
*Assistant Examiner*—Stephen Choi
(74) *Attorney, Agent, or Firm*—Michael R. Schacht; Schacht Law Office, Inc.

(57) ABSTRACT

A fence system for a band saw. The band saw defines an actual cutting plane and has a table having a table surface defining a desired cutting plane. The fence system comprises a rail member, a base member, a locking assembly, a fence member defining a fence surface, and an adjustment system. The rail member is mounted on the table and defines a rail axis that is substantially perpendicular to the desired cutting plane. The base member is supported by the rail member. The locking assembly selectively locks the base member at a selected position along the rail axis. The adjustment system mounts the fence member to the base member at a selected angle relative to the rail axis. The base member defines a pivot point about which the fence member is rotated by the adjustment system, and the pivot point is adjacent to the rail member.

7 Claims, 7 Drawing Sheets

BAND SAW FENCE SYSTEMS AND METHODS

TECHNICAL FIELD

The present invention relates to fences for woodworking equipment and, more particularly, to fences for band saw fences that may be adjusted to compensate for drift introduced by the band saw blade.

BACKGROUND OF THE INVENTION

Band saws basically comprise a table for supporting a workpiece and a blade formed by a thin metal band in the form of a closed loop and having teeth formed on one edge. The blade is supported on upper and lower rollers such that it extends through a hole in the table. The blade is displaced along its axis, and the workpiece is moved relative to the blade to form the cut. The use of a thin metal band allows the cut to follow a curved path. The inherent flexibility of a thin blade, however, makes band saws less appropriate for forming straight cuts.

Fences have long been used with band saws to help form straight cuts. The band saw defines a desired cutting plane that corresponds to a vertical plane extending through the blade at a right angle to the table. A band saw fence is fixed relative to table such that a fence surface is parallel to the desired cutting plane. The workpiece is held against the fence and moved relative to the blade to form the cut.

Depending upon a number of factors, the actual cutting plane of a band saw blade will often "drift" at an angle that is offset from the desired cutting plane. This drift angle is generally consistent for a given machine under a given set of operating condition, but can change over time or if the operating conditions change.

With a conventional band saw fence, the drift of the blade will cause the cut to move towards or away from the fence. If the cut moves towards the fence, the distance between the cut and the edge of the workpiece adjacent to the fence will become smaller than desired, and the workpiece will tend to pull away from the fence. If the cut moves away from the fence, the distance between the cut and the edge of the workpiece adjacent to the fence will become larger than desired, and the workpiece will tend to bind between the fence and the blade. Both scenarios are unfavorable, and the need thus exists for a band saw fence that quickly easily adjusts to accommodate blade drift for different band saws and under different operating conditions.

RELATED ART

The following references were uncovered during a professional patentability search conducted on behalf of the applicants.

Of the patents turned up in the search, only U.S. Pat. No. 3,508,590 to Sprague, Sr. is specifically designed for use with a band saw. While this patent discloses a guide member that is angularly adjustable relative to the saw blade, this guide member is intended to be moved relative to the workpiece to obtain a cross cut and not to form a stable surface for a rip cut. The Sprague, Sr. patent in no way recognizes the problem of blade drift, and the angular adjustment disclosed in this patent could in no way be used accommodate for such blade drift.

U.S. Pat. No. 2,064,607 to Hirtz, Sr. discloses a guide member for woodworking machines, including band saws. The guide member is angularly adjustable. This angular adjustment is described as either making the guide member parallel to the blade or to allow the guide member to function as a stop. This patent fails to recognize any problems specific to band saws, such as blade drift, and thus does not teach using angular adjustment offset such blade drift.

U.S. Pat. Nos. 381,752 and 575,709 to Beach and Drew disclose guide assemblies for table saws having two screws arranged on either side of a pivot point to adjust the angle of a guide member relative to a saw blade. These guide assemblies are not specifically designed for use on band saws. Further, the angular adjustment is designed to allow the guide member to be aligned with the saw blade and not to be offset to accommodate blade drift.

U.S. Pat. No. 2,710,633 to Oberg discloses a miter gauge for a table saw that can also be used as a rip fence. The miter gauge allows angular adjustment, but this patent does not relate to band saws and does not disclose obtaining an offset angle to accommodate blade drift.

U.S. Pat. No. 4,911,048 to Osborne discloses a gauge for a sawmill that is adjustable relative to a rotary saw blade. Again, this patent does not relate to band saws and could not disclose, teach, or suggest the use of an offset angle to accommodate blade drift.

SUMMARY OF THE INVENTION

The present invention may be embodied as a fence system for a band saw. The band saw defines an actual cutting plane and has a table having a table surface defining a desired cutting plane. The fence system comprises a rail member, a base member, a locking assembly, a fence member defining a fence surface, and an adjustment system.

The rail member is mounted on the table and defines a rail axis that is substantially perpendicular to the desired cutting plane. The base member is supported by the rail member. The locking assembly selectively locks the base member at a selected position along the rail axis. The adjustment system mounts the fence member to the base member at a selected angle relative to the rail axis. The base member defines a pivot point about which the fence member is rotated by the adjustment system, and the pivot point is adjacent to the rail member.

The present invention may also be embodied as a method of supporting a workpiece on a band saw to form a desired cut in a work piece. A rail member is mounted onto the table of the band saw. The rail member defines a rail axis that is substantially perpendicular to a desired cutting plane defined by the band saw. A base member is supported on the rail member. The base member is locked at a selected position along the rail axis. A fence member having a fence surface is mounted on the base member. The fence member is attached to the base member such that the fence member engages and rotates about a pivot point on the base member. First and second bolt assemblies are arranged on either side of the pivot point to attach the fence member to the base member at a selected angle relative to the rail axis. The workpiece is then moved relative to the band saw to form the desired cut.

Other configurations of the present invention are also novel, so the scope of the present invention should be determined based on the scope of the claims attached hereto and not this Summary of the Invention.

DETAILED DESCRIPTION OF THE INVENTION

Figure 1:
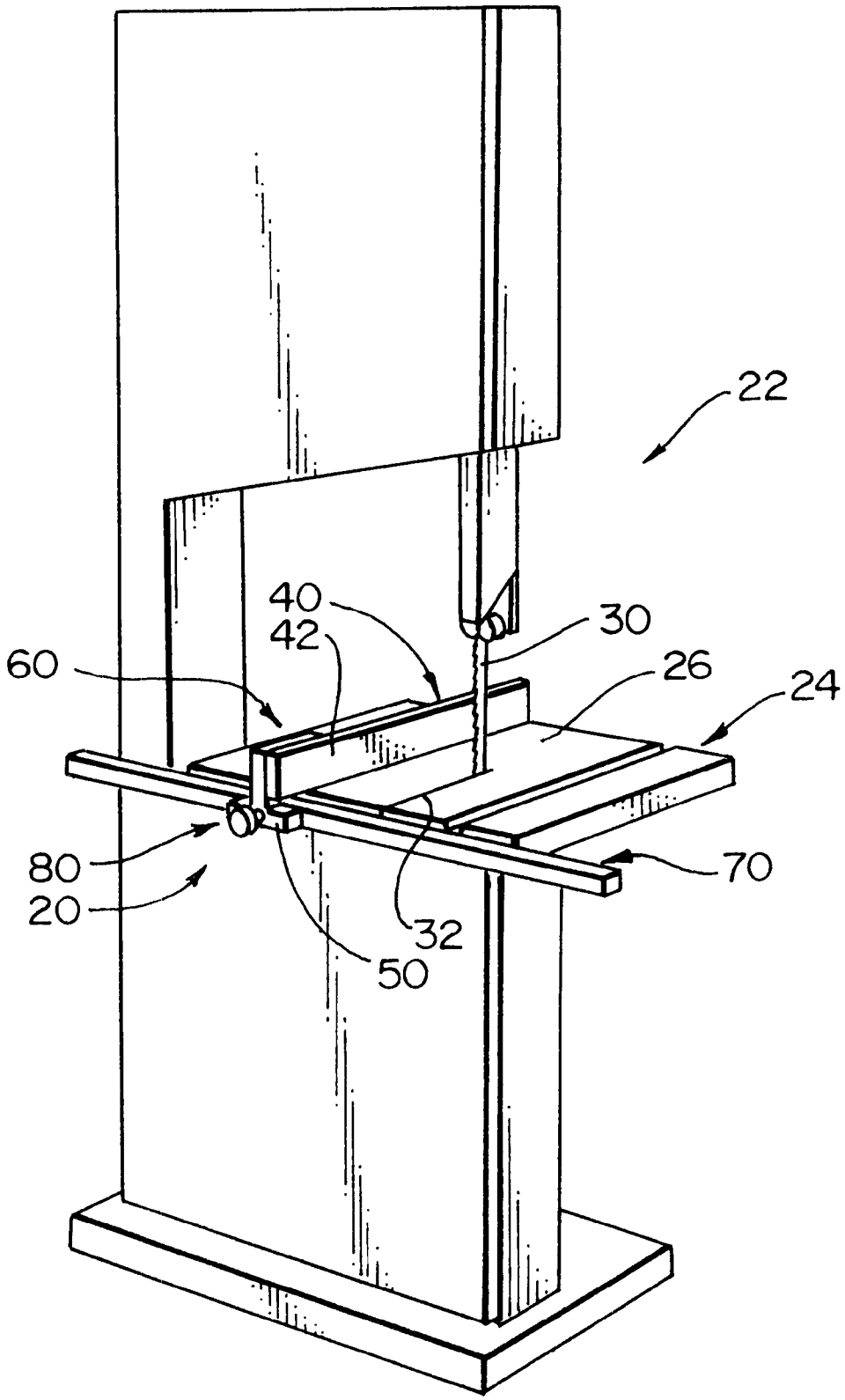
FIG. 1 is a perspective view of a band saw employing a fence system constructed in accordance with, and embodying, the principles of the present invention.

Referring to the drawings, depicted at 20 therein is a fence system constructed in accordance with, and embodying, the principles of the present invention. As shown in FIG. 1, the fence system 20 is mounted on and forms a part of a band saw system 22.

The band saw system 22 is or may be conventional and will be described herein only to the extent necessary for a complete understanding of the present invention. The band saw system 22 has a table 24 defining a table surface 26. A saw blade 30 extends through a saw blade opening 32 in the table 24.

Figure 2:
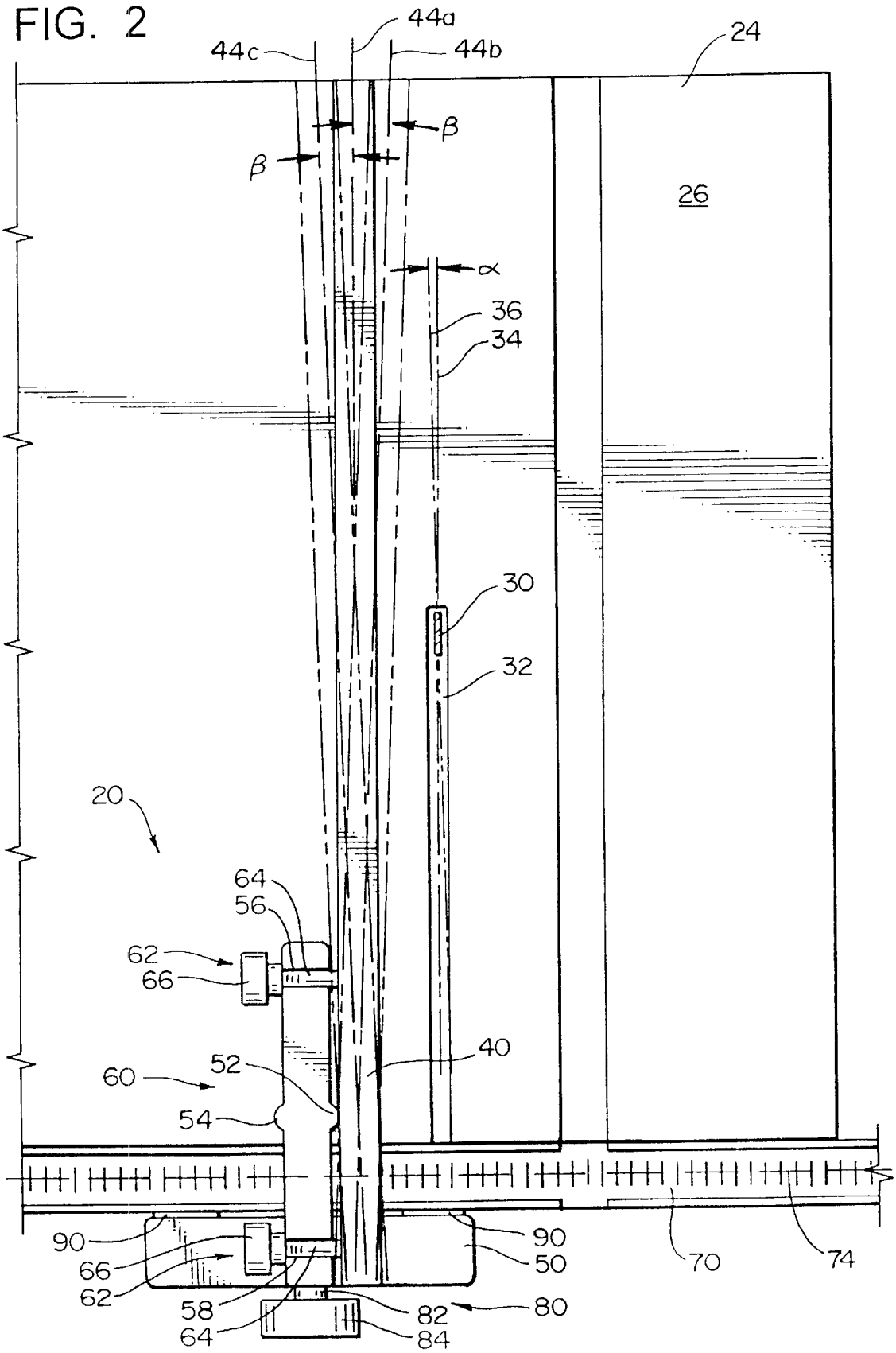
FIG. 2 is a top plan view showing a fence member of the band saw fence system of FIG. 1 extending at different fence angles.

Referring now to FIG. 2, it can be seen that the saw blade opening 32 defines a vertical desired or presumed cutting plane 34. The saw blade 30 lies partly within the desired cutting plane 34; however, in practice, the saw blade 30 will form a cut along an actual cutting plane 36. The actual cutting plane 36 is substantially vertical and may be at an angle to the desired cutting plane 34. An angle $\alpha$ between the desired cutting plane 34 and the actual cutting plane 36 defines the drift angle of the table saw system 22.

The fence system 20 comprises fence member 40 that, during use, defines a fence surface 42. The fence member 40 is an elongate member formed of a relatively rigid material such as metal, wood, or plastic. As is perhaps best shown in FIG. 5, the preferred fence member 40 defines a fence axis 44 that extends through the fence member parallel to the fence surface 42. A fence T-shaped slot 46 is formed in the fence member 40 opposite the fence surface 42. Fence shoulders 48 define the entrance of the slot 46.

Figure 5:
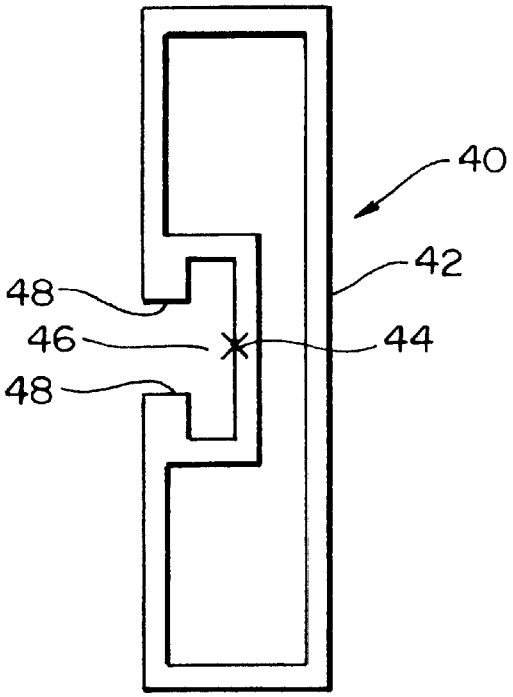
FIG. 5 is an end view of the fence member of FIG. 2.

The fence member 40 is preferably formed of extruded metal. FIG. 5 also shows that the exemplary fence member 40 is symmetrical about a plane extending through the fence axis 44 and perpendicular to the fence surface 42. This symmetry is not necessary to implement the invention in its broadest form, but is desirable as will become apparent from the following discussion.

Figure 3:
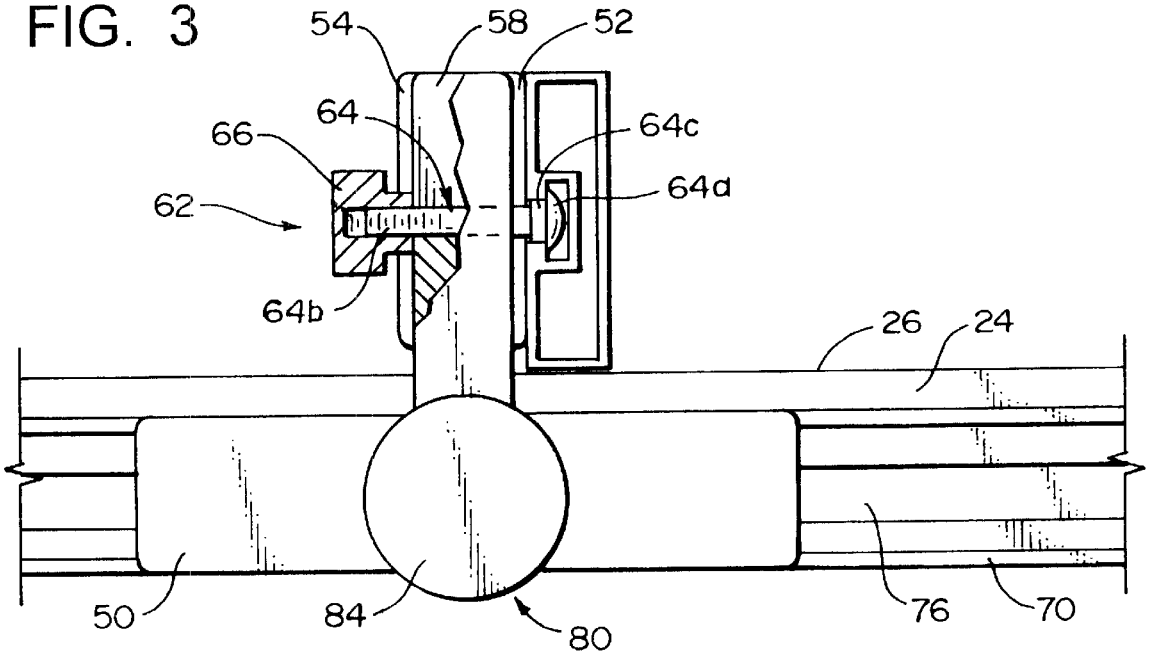
FIG. 3 is a front elevation, partial cut-away view of the band saw fence of FIGS. 1 and 2.
Figure 4:
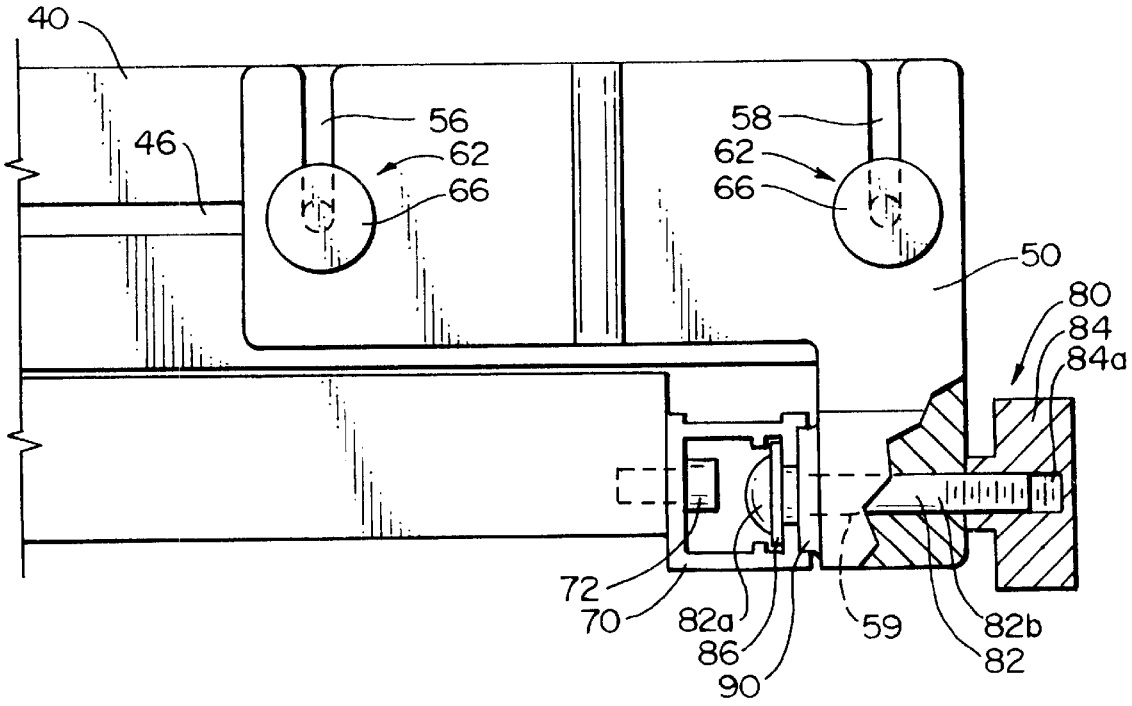
FIG. 4 is a side elevation, partial cut-away view of the band saw fence of FIGS. 1 and 2.

The fence system 20 also comprises a base member 50 (FIG. 4) on which the fence member 40 is supported. The base member 50 defines first and second pivot projections 52 and 54 (FIG. 3) and first and second base slots 56 and 58 (FIG. 4). The pivot projections 52 and 54 are ribs located adjacent to each other on opposing sides of the base member 50. The exemplary pivot projections 52 and 54 are both arranged between and substantially equidistant from the base slots 56 and 58. During use, the pivot projections 52 and 54 and base slots 56 and 58 are substantially vertically oriented.

Referring back to FIG. 2, the fence system 20 also comprises an adjustment system 60 that mounts the fence member 40 onto the base member 50. The adjustment system 60 comprises first and second bolt assemblies 62; each of the bolt assemblies 62 comprises an adjustment bolt 64 and an adjustment knob 66. The adjustment bolts 64 are or may be conventional carriage bolts that, as shown in FIG. 3, comprise a head portion 64*a*, a shaft portion 64*b*, and a nut portion 64*c*; the nut portion 64*c* is between the head and shaft portions 64*a* and 64*b*. The adjustment knobs 66 define shaft cavities 66*a* threaded to receive threaded portions of the bolt shafts 64*b*.

Figure 6:
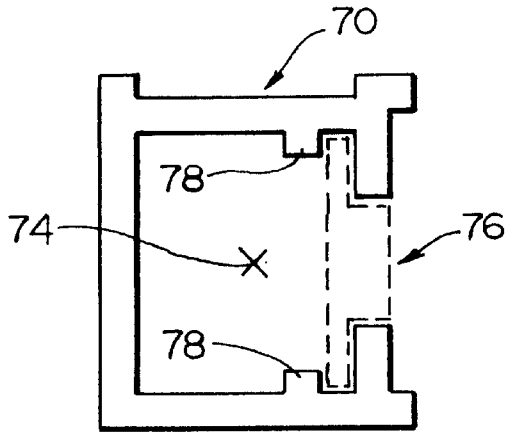
FIG. 6 is an end view of a rail member employed by the fence system of FIG. 1.

A rail member 70 is mounted by rail bolts 72 to the band saw table 24. As shown in FIG. 6, the rail member 70 defines a rail axis 74 and a rail slot 76. Rail flanges 78 define a portion of the rail slot 76 such that the slot 76 is effectively T-shaped in cross-sectional area. As can be seen from FIG. 2, the rail member 70 is mounted to the table 24 such that the rail axis 74 is substantially perpendicular to the desired cutting plane 34. In addition, FIG. 4 shows that, when the rail member 70 is mounted to the table 24, the rail slot 76 is oriented away from the table 24.

The fence system 20 further comprises a locking system 80 that locks the base member 50 at a desired location along the rail member 70. The locking system 80 comprises a locking bolt 82, a locking knob 84, and a washer 86. The locking bolt 82 defines a head portion 82*a* and a shaft portion 82*b*. The locking knob 84 defines a threaded knob cavity 84*a* adapted to receive a threaded portion of the locking bolt shaft 82*b*.

The exemplary fence system 20 further comprises one or more optional bearing members 90. The bearing members 90 are arranged to reduce wear between the base member 50 and the rail member 70.

The fence system 20 is assembled as follows. Initially, the first and second bolt assemblies 62 are slid into the ends of the fence slot 46 such that the bolt head portions 64*a* are within the fence slot 46, as perhaps best shown in FIG. 3. The nut portions 64*c* of the bolts 64 engage the fence shoulders 48 to prevent axial rotation of the bolts 64, and the bolt head portions 64*a* are larger than the distance between the fence shoulders 48 to prevent the bolts 64 from moving out of the slot 46 between the shoulders 48.

Referring now to FIG. 4, the shaft portion 82*b* of the locking bolt 82 is inserted through the washer 86, and the head portion 82*a* of the locking bolt 82 is the placed into the rail slot 76 defined by the rail member 70. The shaft portion 82*b* of the locking bolt 82 is next passed through lock opening 59 formed in the base member 50; if necessary, the locking bolt shaft portion 82 also extends through a corresponding opening in the optional bearing members 90. The locking knob 84 is then threaded on to the locking bolt 82 such that a portion of the base member 50 is arranged between the rail member 70 and the locking knob 84.

At this point, the first and second pivot projections 52 and 54 are spaced a predetermined spacing distance from the saw blade 30. The predetermined spacing distance is defined as the straightest distance between one or the other of the pivot projections from the saw blade when the projections 52 and 54 are within the desired cutting plane 34. The predetermined spacing distance is not critical to implement the principles of the present invention, and the determination of this distance will be apparent to one of ordinary skill in the art based on the present disclosure.

The fence member 40 is then moved such that the shaft portions 64*b* of the adjustment bolts 64 are received within the first and second slots 56 and 58 in the base member 50, as shown in FIG. 4. The adjustment knobs 66 are threaded onto the adjustment bolts 64 such that a portion of the base member 50 is arranged between the fence member 40 and the adjustment knobs 66. Rotation of the knobs 66 relative to the bolts 64 thus causes the knobs 66 to move toward or away from the bolt head portions 64*b*.

Because axial rotation of the adjustment bolts 64 is prevented and the head portions 64*a* engage the fence shoulders 48, rotation of the knobs 66 in one direction exerts forces on the rail member 40 towards the base member 50. Because the adjustment bolts 64 are received by the base slots 56 and 58 and thus are located on either side of the pivot projections 52 and 54, the fence member 40 pivots about the first pivot projection 52, and the angle of the fence axis 44 relative to the rail axis 74 may be fixed at a desired value.

As shown in FIG. 2, the adjustment system 60 allows the angle of the fence axis 44 relative to the rail axis 74 to move within a predetermined adjustment range defined as an angle of 2β centered on a reference plane parallel to the desired cutting plane 34. The adjustment system 60 also allows the angle of the fence axis 44 to be fixed anywhere within this adjustment range.

By loosening the locking knob 84, the base member 50 and fence member 40 may be moved along the rail member 70. By tightening the locking knob 84, the location of the base member 50 and fence member 40 may be fixed at a desired location along the rail member 70.

Figure 7:
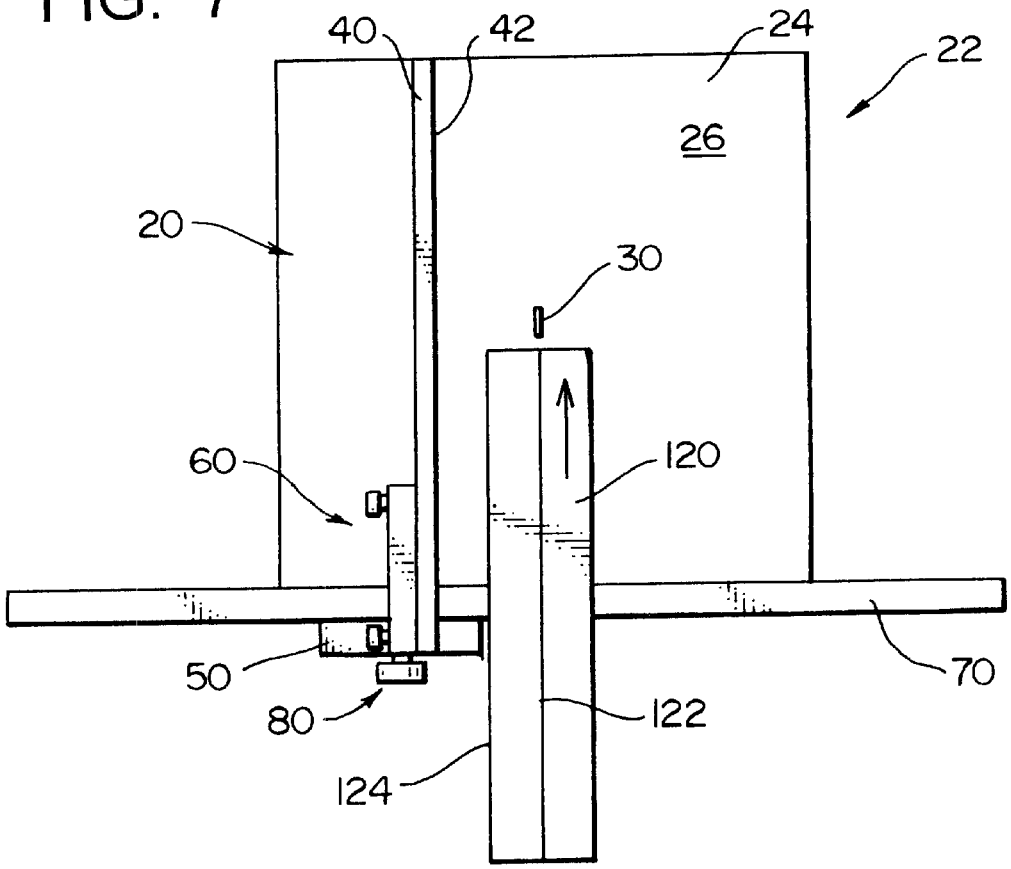
FIGS. 7–9 are top plan views of the method of setting the fence angle defined by the fence member.
Figure 8:
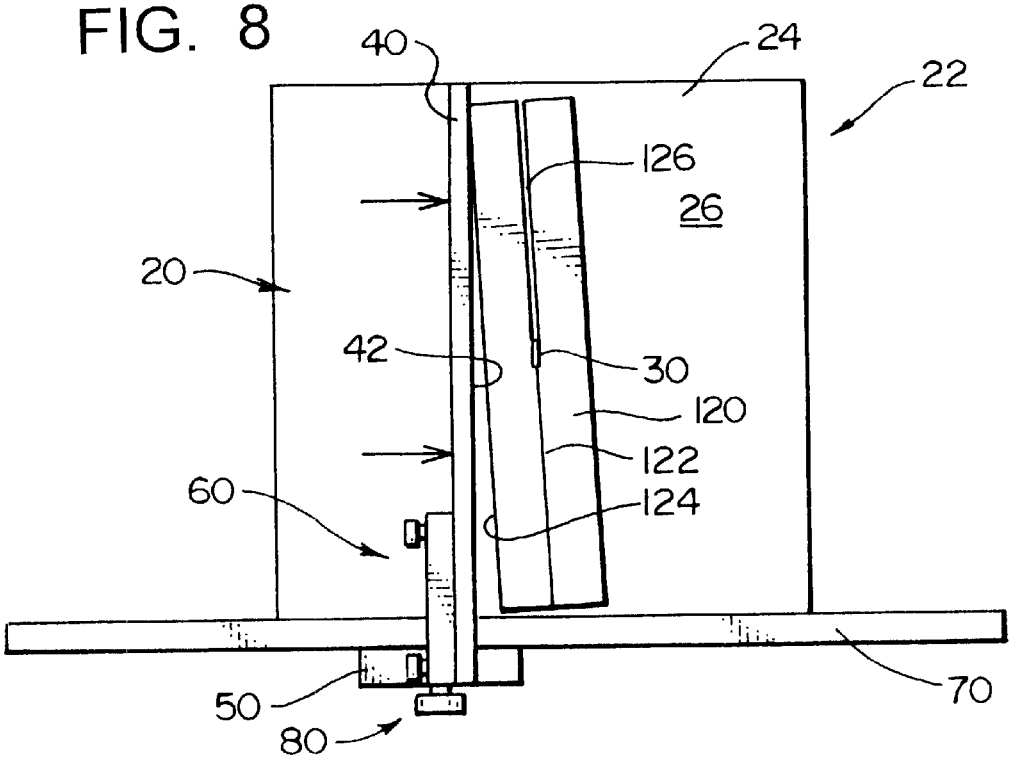
Figure 9:
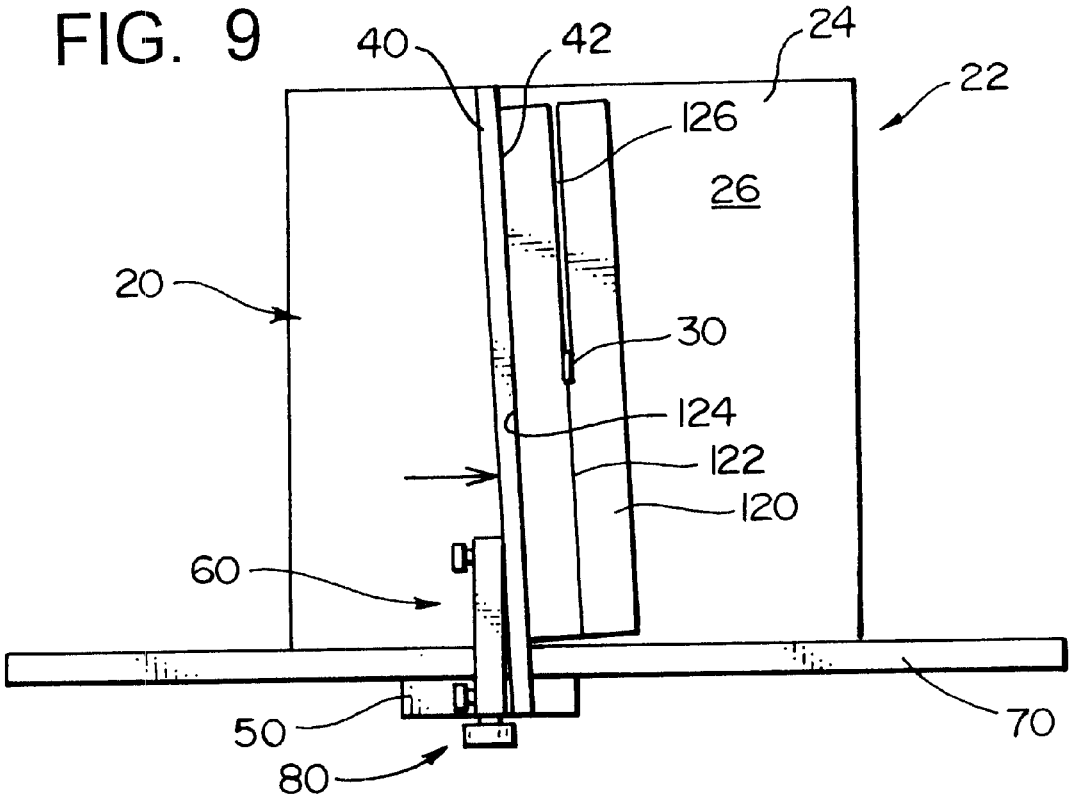
Figure 10:
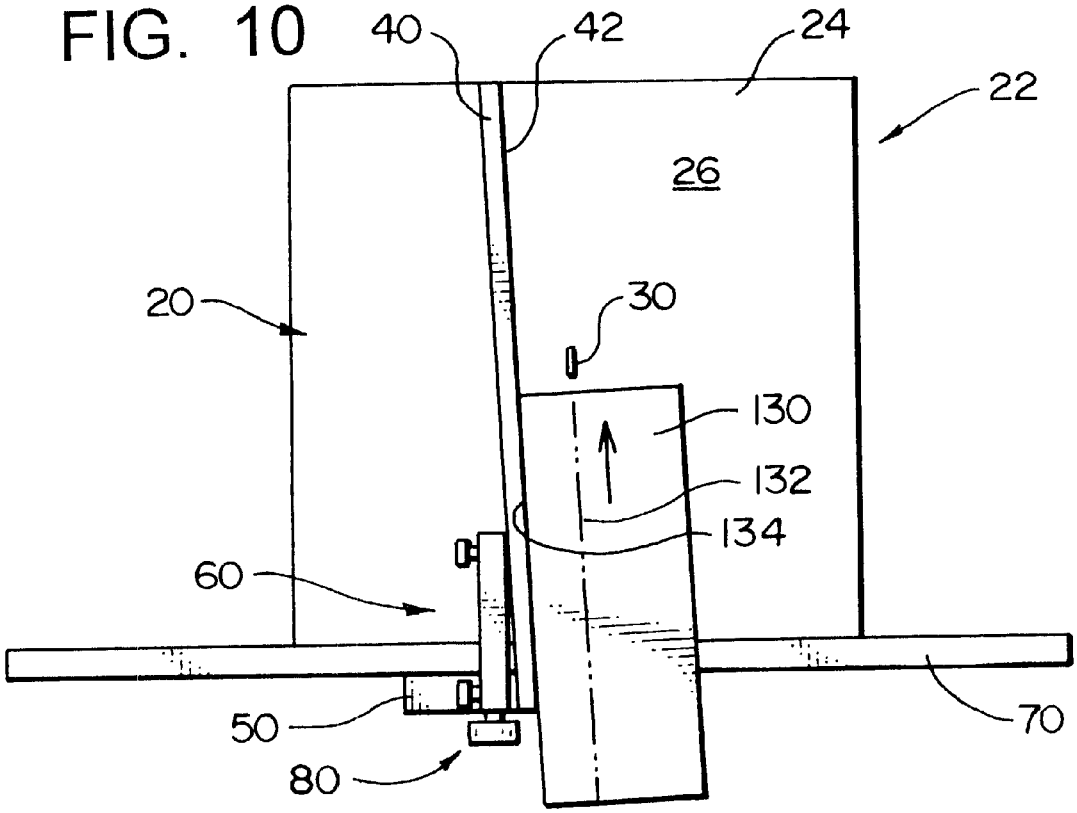
FIGS. 10 and 11 are top plan views depicting the method of using the fence system of FIGS. 1 and 2.
Figure 11:
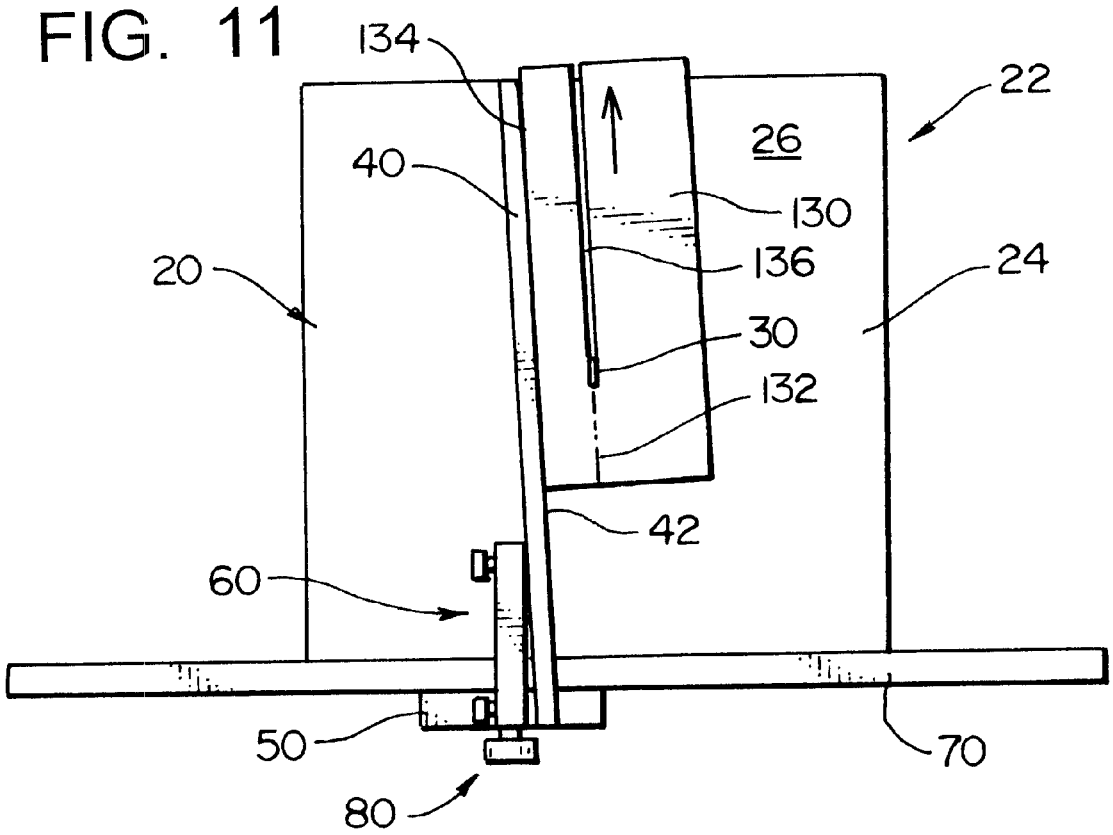

The band saw system 22 using the fence system 20 is set up and used as follows. Initially, the drift angle must be measured. On a testpiece 120, a reference line 122 is formed parallel to a straight reference edge 124. With the fence member 40 spaced from the testpiece 120 as shown in FIGS. 7 and 8, the testpiece 120 is moved as necessary to cause the saw blade 30 to form a cut 126 along the reference line 122. Part of the way through the testpiece 120, the position of the testpiece 120 is fixed relative to the table 24. The fence member 40 is then moved as shown in FIGS. 8 and 9 until the fence surface 42 engages, and is parallel to, the reference edge 124. The adjustment system 60 is then operated by tightening the first and second bolt assemblies 62 until the fence member 40 is fixed relative to the base member 50. The fence surface 42 is now parallel to the actual cutting plane 36.

At this point, a workpiece 130 having a cutting line 132 marked thereon is placed onto the table surface 26. The cutting line 132 is substantially parallel to a cutting edge 134 of the workpiece 130. The workpiece 130 is held against the fence surface 42 and the locking assembly 80 loosened to allow movement of the base member 50 relative to the rail member 70. The fence member 40 and workpiece 130 are thus moved together until the saw blade 30 is aligned with the cutting line 132. The locking assembly 80 is then tightened to fix a location of the base member 50 along the rail member 70. The workpiece 130 is then moved towards the saw blade 30 while being held against the fence surface 42 to form a cut 136 in the workpiece 130 along the cutting line 132.

Because the angle of the fence member 40 has been set parallel to the actual cutting plane 36 instead of the desired cutting plane 34, blade drift does not cause the workpiece 130 to bind between the blade 30 and the fence surface 42 or to separate from the fence surface 42.

The fence system 20 can easily be configured to operate on the opposite side of the blade member 30. In particular, the adjustment knobs 66 are loosened such that fence member 40 may be lifted relative to the base member 50 and the adjustment bolts 64 removed from the first and second slots 56 and 58. The fence member 40 is then flipped over such that the adjustment knobs 66 are on the opposite side. The fence member 40 is further displaced such that the adjustment bolts 64 again enter the first and second slots 56 and 58; but in this configuration, the fence member engages the second pivot projection 54 rather than the first pivot projection 52. The process of making the fence surface 42 parallel to the actual cutting plane 36 and cutting the workpiece 130 are the same.

From the foregoing, it should be apparent that the present invention may be embodied in forms other than those described above. For example, the exemplary band saw system 22 is a two-wheel system, but other band saw configurations may be used with similar effect. The scope of the present invention should thus be determined by the following claims and not the foregoing detailed description.

I claim:

1. A fence system for a band saw comprising a saw blade defining an actual cutting plane and having a table having a table surface defining a desired cutting plane, where the actual cutting plane is offset from the desired cutting plane, the fence system comprising:

a single rail member mounted along one edge of the table, where the rail member defines a rail axis that is substantially perpendicular to the desired cutting plane;

a base member supported by the rail member, the base member defining a first pivot projection;

a locking assembly to selectively lock the base member at a selected position along the rail axis;

a fence member that defines a fence surface; and an adjustment system that mounts the fence member to the base member such that the fence member pivots about the first pivot projection at a selected angle relative to the rail axis; whereby the adjustment system comprising first and second screw assemblies, the screw assemblies having axis substantially parallel to the rail axis;

the base member is supported by the rail member such that the first pivot projection is adjacent to the rail member; and the adjustment system is operated such that the selected angle is substantially parallel to the actual cutting plane defined by the saw blade.

2. A fence system as recited in claim 1, in which the adjustment system comprises:

the first screw assembly extending between the base member and the fence member on a first side of the pivot projection; and the second screw assembly extending between the base member and the fence member on a second side of the pivot projection; whereby operating the first and second screw assemblies allows the fence member to be locked into the selected angle.

3. A fence system as recited in claim 2, in which the first and second screw assemblies comprise:

a bolt member having a head portion and a shaft portion, where the head portion engages the fence member; and a knob member that engages base member, where the knob member engages the shaft portion of the bolt member such that rotation of the knob member relative to the bolt member increases or decreases a distance between the head portion of the bolt member and the knob member.

4. A fence system as recited in claim 2, in which the first and second screw assemblies are supported by first and second vertical slots formed in the base member.

5. A fence system as recited in claim 2, in which the head portions of the first and second screw assemblies are supported by a horizontal slot formed in the fence member.

6. A fence system as recited in claim 4, in which the head portions of the first and second screw assemblies are supported by a horizontal slot formed in the fence member.

7. A fence system as recited in claim 6, in which the first and second screw assemblies comprise:

a bolt member having a head portion and a shaft portion, where the head portion engages the fence member; and a knob member that engages base member, where the knob member engages the shaft portion of the bolt member such that rotation of the knob member relative to the bolt member increases or decreases a distance between the head portion of the bolt member and the knob member.

* * * * *